United States Patent [19]

Summerville

[11] Patent Number: 4,998,297

[45] Date of Patent: Mar. 12, 1991

[54] SANITARY TOILET SEAT COVER

[76] Inventor: Jeanie Summerville, 6034 Fairfield Ave., Apt. C, Fort Wayne, Ind. 46807

[21] Appl. No.: 489,380

[22] Filed: Mar. 6, 1990

[51] Int. Cl.[5] ..... A47K 13/14

[52] U.S. Cl. ..... 4/242

[58] Field of Search ..... 4/242, 243, 452, 457, 4/247

[56] References Cited

U.S. PATENT DOCUMENTS

| | | | |
|---|---|---|---|
| 992,173 | 5/1911 | Darms . | |
| 1,070,618 | 8/1913 | Leatherland | 4/243 |
| 1,268,024 | 5/1918 | Levin . | |
| 1,358,222 | 11/1920 | Levy . | |
| 1,456,685 | 5/1923 | Wilder | 4/243 |
| 1,524,853 | 2/1925 | Beam . | |
| 1,530,424 | 3/1925 | Shollar | 4/242 |
| 1,601,088 | 9/1926 | Sullivan et al. | 4/247 |
| 1,643,413 | 9/1927 | Mahoney . | |
| 1,835,787 | 12/1931 | Knisely . | |
| 1,863,499 | 6/1932 | Phillips | 4/247 |
| 2,481,427 | 9/1949 | Hunter | 4/242 X |
| 2,742,650 | 4/1956 | Mohun et al. . | |
| 4,525,880 | 7/1985 | Bass . | |
| 4,806,406 | 2/1989 | Akerman et al. . | |

FOREIGN PATENT DOCUMENTS

| | | | |
|---|---|---|---|
| 1954289 | 5/1971 | Fed. Rep. of Germany | 4/243 |
| 283368 | 6/1952 | Switzerland | 4/243 |

*Primary Examiner*—Charles E. Phillips

*Attorney, Agent, or Firm*—Richard L. Robinson; George Pappas

[57] ABSTRACT

A sanitary toilet seat cover includes a flexible ring-shaped seat portion having an upper surface and a lower surface and a diametrical axis. A flap portion extends generally radially outwardly from the seat portion along the diametrical axis. Releasable fasteners are provided for releasably fastening the flap portion to the seat portion when the seat portion is rolled up, the fasteners including first and second mutually engagable fastening elements, the first fastening element being fixed to the flap portion and the second fastening element being fixed to the seat portion. The sanitary toilet seat cover is compactly arranged for storage by folding the seat portion in half along the diametrical axis, rolling up the folded seat portion upon itself semi-circumferentially starting at that end which is opposite the flap portion, and folding the flap portion endwise across the rolled-up seat portion and engaging the first fastening element of the flap portion to the second fastening element of the seat portion.

10 Claims, 1 Drawing Sheet

SANITARY TOILET SEAT COVER

BACKGROUND OF THE INVENTION

The present invention relates generally to sanitary toilet seat covers which are used for temporarily covering the seat of a toilet while in use, and more particularly to a sanitary toilet seat cover that is easily transportable and storable.

Many people are reluctant to have contact with a toilet seat outside their own homes, especially one located in a public rest room, out of concern for the risk of disease transmission and for other reasons. Consequently, a variety of personal sanitary toilet seat covers have been proposed which have as their main object the provision of a temporary physical barrier between the permanent toilet seat and the user's body. In order for such a personal sanitary toilet seat cover to be optimally useful, it is necessary that it be easily and compactly storable and transportable so that it can be carried on or about the person, thus being readily available when needed. It would therefore be desireable to provide a sanitary toilet seat cover configured such that it can be conveniently and discretely carried in one's purse, coat pocket or automobile glove compartment, for example.

SUMMARY OF THE INVENTION

A sanitary toilet seat cover in accordance with the present invention involves a flexible ring-shaped seat portion having an upper surface and a lower surface and a diametrical axis. The seat portion is configured to be rolled up for storage. A flap portion extends generally radially outwardly from the seat portion along the diametrical axis. Releasable fastener means are provided for releasably fastening the flap portion to the seat portion when the seat portion is rolled up, the fastener means including first and second mutually engagable fastening elements, the first fastening element being fixed to the flap portion and the second fastening element being fixed to the seat portion.

In accordance with another aspect of the present invention, a method of compactly arranging for storage a sanitary toilet seat cover as described above involves the steps of:

(a) folding the seat portion in half along the diametrical axis;

(b) rolling up the folded seat portion upon itself semicircumferentially starting at that end which is opposite the flap portion; and (c) folding the flap portion endwise across the rolled-up seat portion and engaging the first fastening element of the flap portion to the second fastening element of the seat portion.

It is an object of the present invention to provide a personal sanitary toilet seat cover which is easily and compactly storable and transportable on or about the person, and which can be easily re-stored after use.

It is a further object of the present invention to provide a method of arranging for storage such a personal sanitary toilet seat cover.

Further objects and advantages of the present invention will be apparent from the following descriptions of a preferred embodiment with reference to the attached drawings.

DESCRIPTION OF THE PREFERRED EMBODIMENT

Figure 1:
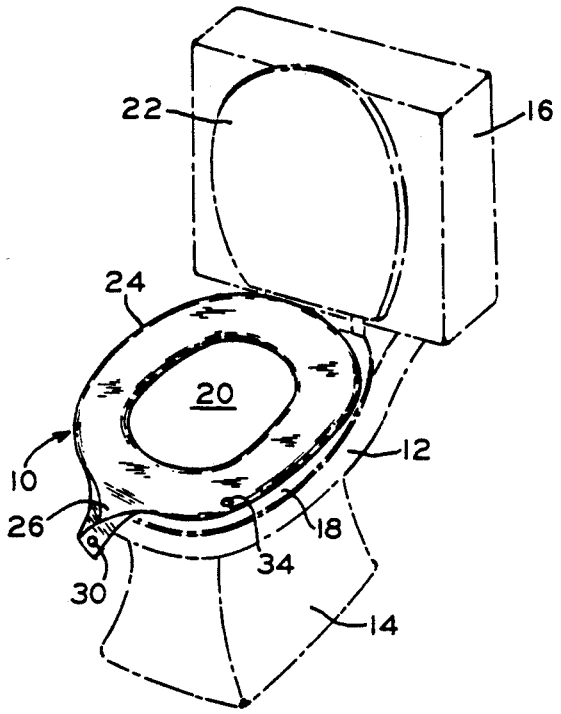
FIG. 1 is a perspective view of a sanitary toilet seat cover in accordance with the present invention, shown placed on a conventional toilet seat for use.

Referring in particular to FIG. 1, there is illustrated a sanitary toilet seat cover 10 in accordance with the present invention. Seat cover 10 is illustrated as it would be positioned for use on a conventional porcelain toilet of the type having a bowl 12, a support pedestal 14, a water tank 16, a seat 18 having a central opening 20 therethrough, and a hinged lid 22. While seat cover 10 is shown for purposes of illustration in the environment of a particular type of toilet, it should be understood that seat cover 10 is not restricted to use with such toilet configurations, but can be used with any of the various toilet configurations found in residential and commercial installations, since they all include at least a seat having a central opening.

Figure 2:
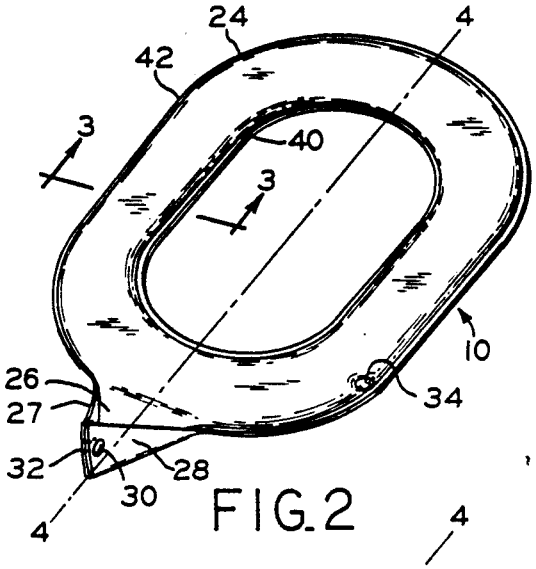
FIG. 2 is an enlarged perspective view of the sanitary toilet seat cover of FIG. 1.
Figure 3:
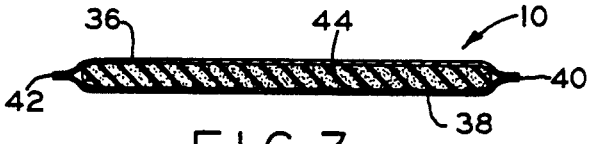
FIG. 3 is a sectional view of the sanitary toilet seat cover of FIG. 1, taken along section line 3—3 of FIG. 2 and viewed in the direction of the arrows.

Referring to FIGS. 2 and 3, seat cover 10 is illustrated in greater detail. Seat cover 10 includes a generally ring-shaped seat portion 24 and a flap portion 26. Seat portion 24, in conformity with common toilet seat design, is an oval ring elongated along a longitudinal diametrical axis 4—4 which runs from front to back with reference to the toilet seat 18 on which it is to be placed. Seat portion 24 is substantially flat and lies in a generally horizontal plane while placed upon toilet seat 18, although it should be appreciated that seat cover 10 is constructed to be flexible and therefore does not remain rigidly flat during use but more or less conforms itself to the shape of the toilet seat 18 on which it is placed. Flap portion 26 is coextensive with seat portion 24 and extends generally radially outwardly from seat portion 24 along diametrical axis 4—4. Flap portion 26 is subdivided into left and right sides 27 and 28, respectively, by diametrical axis 4—4, with flap portion 26 being folded along diametrical axis 4—4 such that left and right sides 27 and 28 are folded upon each another. A first fastening element 30, being the male half of a conventional snap fastener, extends through and joins left and right sides 27 and 28 together to form a generally upstanding flap portion 32 centered on diametrical axis 4—4 that extends upwardly generally perpendicular to the horizontal plane of seat portion 24. As viewed in FIG. 2, the working end of the male snap fastener 30 extends to the left. A mating second fastening element 34, being the female half of a conventional snap fastener, extends through seat portion 24 adjacent an outer peripheral edge thereof. As viewed in FIG. 2, the working end of the female snap fastener 34 extends downwardly.

With particular reference to FIG. 3, seat portion 24 is shown in cross-section. Seat portion 24 includes an upper surface 36 comprised of a flexible plastic sheet material that is easily cleanable, such as vinyl, and a similar lower surface 38 comprised of a like flexible plastic sheet material. Upper surface 36 and lower surface 38 are joined to one another along inner and outer peripheral edges 40 and 42. Preferably, the joinder of the upper and lower surfaces is effected by welding of the respective plastic sheets to one another to provide a waterproof seal. Disposed between upper and lower surfaces 36 and 38 and enclosed by edges 40 and 42 is a ring-shaped padding layer 44 preferably composed of a resilient material such as foam rubber.

To make use of the sanitary protective advantages of the present invention, one would place seat cover 10 on toilet seat 18, as shown in FIG. 1, such that the seating surfaces of toilet seat 18 are covered by seat portion 24 and such that flap portion 26 extends forwardly with respect to toilet seat 18 along the longitudinal diametrical axis of toilet seat 18. The toilet can then be used in conventional fashion, but without any actual contact between the user's body and toilet seat 18.

After use, sanitary toilet seat cover 10 can be removed from toilet seat 18 and compactly stored for transportation. The preferred method of compactly storing seat cover 10 is illustrated sequentially in FIGS. 4–7.

Figure 4:
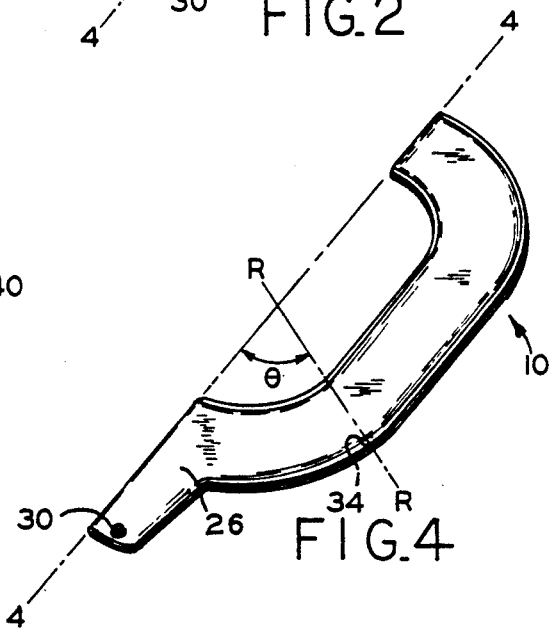
FIG. 4 is a perspective view of the sanitary toilet seat cover of FIG. 1, shown folded along diametrical axis 4—4 of FIG. 2.

Referring to FIG. 4, seat cover 10 is first folded in half along diametrical axis 4—4 such that upper surface 36 is folded against itself and the inner and outer peripheral edges 40 and 42, respectively, are substantially aligned with themselves. Flap portion 26, which is already partially folded upon itself along diametrical axis 4—4 due to snap fastener 30, is now completely folded upon itself and lies in the same plane as folded seat portion 24. As shown in FIG. 4, the working end of male snap fastener 30 faces upwardly while the working end of female snap fastener 34 faces downwardly. It should be noted that female snap fastener 34 is displaced circumferentially from male snap fastener 30 along seat portion 24. A radius R—R of seat portion 24 passing through female snap fastener 34 subtends an acute angle $\theta$ of about 45° with respect to a radius passing through male snap fastener 30.

Figure 5:
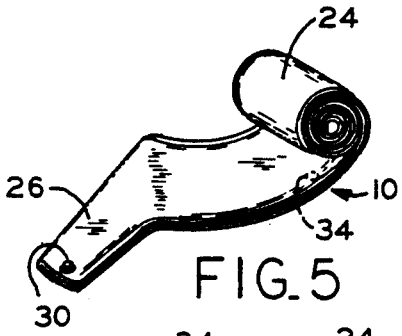
FIG. 5 is a perspective view of the sanitary toilet seat cover of FIG. 1, shown folded and partially rolled-up.

With reference to FIG. 5, seat cover 10 is shown folded in half as in FIG. 4, and also partially rolled up, starting from that end which is opposite flap portion 26. That is, seat portion 24 is rolled upon itself semi-circumferentially in spiral fashion starting at the rear end of seat portion 24 and proceeding toward flap portion 26.

Figure 6:
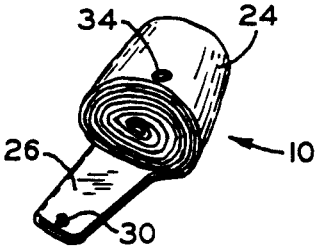
FIG. 6 is a perspective view of the sanitary toilet seat cover of FIG. 1, shown folded and fully rolled-up.

FIG. 6 shows seat portion 24 fully rolled up upon itself such that female snap fastener 34 is aligned for engagement with male snap fastener 30. The circumferential displacement of female snap fastener 34 from male snap fastener 30 along seat portion 24 is selected to produce such an aligned result when seat portion 24 is rolled up. Stated another way, the circumferential displacement of snap fastener 34 from snap fastener 30 along seat portion 24 is equal to approximately one half the roll circumference of the rolled up seat portion as illustrated in FIG. 6.

Figure 7:
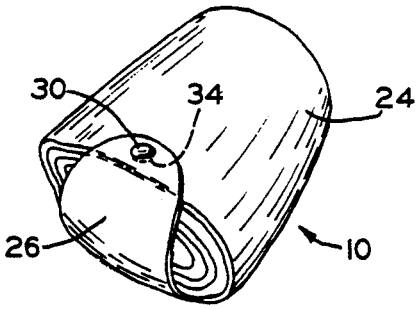
FIG. 7 is a perspective view of the sanitary toilet seat cover of FIG. 1, shown folded and fully rolled-up, and with the flap portion folded endwise across the rolled-up seat cover and fastened thereto by fastening elements.

Finally, with reference to FIG. 7, flap portion 26 is folded endwise across the rolled up seat portion 24 and male snap fastener 30 is engaged with female snap fastener 34 to retain seat cover 10 in a rolled up condition.

It should be appreciated that the above-described steps for storing seat cover 10 after use can of course be used also prior to initial use to place seat cover 10 in an easily transportable and storable configuration. Also, one need only reverse the order of the steps described above to remove seat cover 10 from its stored configuration and place it in its useful configuration as illustrated initially in FIG. 1.

While the present invention has been particularly described in terms of a preferred embodiment, it should be understood that no limitation of the scope of the invention is intended thereby, and that the scope of the invention includes variations, uses or adaptations of the invention following the general principles thereof, including such departures from the present disclosure as come within known or customary practice in the art to which this invention pertains, limited only by the claims appended hereto.

What is claimed is:

1. A sanitary toilet seat cover comprising:

a flexible ring-shaped seat portion having an upper surface and a lower surface and a diametrical axis;

a flap portion extending generally radially outwardly from said seat portion along said diametrical axis;

said cover having a first configuration and a second configuration, where in said first configuration said cover is substantially planar and where in said second configuration said seat portion and flap portion are folded in half along said diametrical axis and rolled up spirally and semi-circumferentially starting from that end of the folded seat portion which is opposite said flap portion; and releasable fastener means for releasably fastening said flap portion to said seat portion when said seat portion is rolled up, said fastener means including first and second mutually engagable fastening elements, said first fastening element being fixed to said flap portion and said second fastening element being fixed to said seat portion.

2. The sanitary toilet seat cover of claim 1, in which said first and second fastening elements are each disposed along a respective radius of said seat portion, said respective radii subtending an acute angle.

3. The sanitary toilet seat cover of claim 2, in which said subtended acute angle is of such a value that said first and second fastening elements are aligned for mutual engagement when said seat portion is folded and rolled up in said second configuration.

4. The sanitary toilet seat cover of claim 1, in which said second fastening element is displaced circumferentially from said first fastening element along said seat portion by a distance approximately equal to one half the roll circumference of said seat portion when said seat portion is folded and rolled up in said second configuration.

5. The sanitary toilet seat cover of claim 1, in which said upper surface and said lower surface are comprised of a waterproof plastic sheet material.

6. The sanitary toilet seat cover of claim 5, in which said seat portion includes a padding layer disposed between said upper surface and said lower surface.

7. The sanitary toilet seat cover of claim 6, in which said padding layer includes resiliently compressible foam rubber.

8. A sanitary toilet seat cover comprising:

a flexible ring-shaped seat portion having an upper surface and a lower surface and a diametrical axis;

a flap portion extending generally radially outwardly from said seat portion along said diametrical axis;

said flap portion being generally coextensive with said seat portion and being subdivided into left and right flap sides by said diametrical axis, said left flap side and said right flap side of said flap portion being folded upon one another substantially along said diametrical axis and being joined together to define an upstanding flap portion, said first fastening element being fixed to said upstanding flap portion; and releasable fastener means for releasably fastening said flap portion to said seat portion when said seat portion is rolled up, said fastener means including first and second mutually engagable fastening elements, said first fastening element being fixed to said flap portion and said second fastening element being fixed to said seat portion.

9. The sanitary toilet seat cover of claim 8, in which said first fastening element is located on said upstanding flap portion so as to face in a direction away from said second fastening element when said seat portion is unfolded, and said second fastening element is located on said seat portion so as to face downwardly relative to said upstanding flap portion.

10. A method of compactly arranging for storage a sanitary toilet seat cover including a flexible ring-shaped seat portion having an upper surface and a lower surface and a diametrical axis, a flap portion generally coextensive with said seat portion and extending generally radially outwardly from said seat portion along said diametrical axis, and releasable fastener means for releasably fastening said flap portion to said seat portion, said fastener means including first and second mutually engagable fastening elements, said first fastening element being fixed to said flap portion and said second fastening element being fixed to said seat portion, comprising the steps of:

(a) folding said seat portion and said flap portion in half along said diametrical axis;

(b) rolling up said folded seat portion upon itself spirally and semi-circumferentially starting at that end which is opposite said flap portion; and (c) folding said flap portion endwise across the rolled-up seat portion and engaging the first fastening element of said flap portion to the second fastening element of said seat portion.

* * * * *